US010688332B2

(12) United States Patent
Carnago et al.

(10) Patent No.: US 10,688,332 B2
(45) Date of Patent: Jun. 23, 2020

(54) PORTABLE EXERCISE APPARATUS COMPRISING RESISTANCE GENERATING MEMBER IN THE FORM OF A PLUNGER CARRIED ON LIMB RECEIVING MEMBER OF THE EXERCISE APPARATUS

(71) Applicants: Hal Medi Carnago, Englefeld (CA); Vincent Anthony Colistro, Saskatoon (CA)

(72) Inventors: Hal Medi Carnago, Englefeld (CA); Vincent Anthony Colistro, Saskatoon (CA)

( * ) Notice: Subject to any disclaimer, the term of this patent is extended or adjusted under 35 U.S.C. 154(b) by 0 days.

(21) Appl. No.: 16/246,730

(22) Filed: Jan. 14, 2019

(65) Prior Publication Data

US 2019/0269954 A1 Sep. 5, 2019

Related U.S. Application Data

(63) Continuation-in-part of application No. 15/918,118, filed on Mar. 12, 2018, now Pat. No. 10,456,618.

(60) Provisional application No. 62/592,133, filed on Nov. 29, 2017.

(51) Int. Cl.

| | |
|---|---|
| ***A63B 21/008*** | (2006.01) |
| ***A63B 22/20*** | (2006.01) |
| ***A63B 21/00*** | (2006.01) |
| ***A63B 21/02*** | (2006.01) |

(52) U.S. Cl.

CPC ..... *A63B 21/0083* (2013.01); *A63B 21/028* (2013.01); *A63B 21/4034* (2015.10); *A63B 22/203* (2013.01); *A63B 2210/50* (2013.01)

(58) Field of Classification Search

CPC ..... A63B 21/0083; A63B 22/203; A63B 21/4034; A63B 21/028; A63B 2210/50

See application file for complete search history.

(56) References Cited

U.S. PATENT DOCUMENTS

| | | | | | |
|---|---|---|---|---|---|
| 3,363,335 | A * | 1/1968 | Burhns | A61H 1/02 | 434/255 |
| 3,582,069 | A * | 6/1971 | Flick | A63B 21/154 | 482/70 |
| 3,589,720 | A * | 6/1971 | Agamian | A63B 21/012 | 482/114 |
| 4,364,559 | A * | 12/1982 | Valentine | A63B 21/055 | 482/130 |
| 4,799,475 | A * | 1/1989 | Iams | A63B 23/0355 | 434/255 |
| 5,279,531 | A * | 1/1994 | Jen-Huey | A63B 23/0417 | 482/51 |

(Continued)

*Primary Examiner* — Garrett K Atkinson

(74) *Attorney, Agent, or Firm* — Adrian D. Battison; Ade & Company Inc; Ryan W. Dupuis

(57) ABSTRACT

An exercise apparatus for use in for example a leg exercise comprises at least one track each extending in a respective longitudinal direction, and each carrying in sliding movement therealong a limb receiving member for supporting a limb of the user. The apparatus includes a resistance generating member in the form of a plunger cooperating with a stop surface to provide gradual resistance to movement of the limb receiving member in a user-driven direction. The resistance generating member is mounted on the limb receiving member so as to be movable therewith and is arranged for releasable contact with the stop surface defined on the respective track.

11 Claims, 12 Drawing Sheets

(56) References Cited

U.S. PATENT DOCUMENTS 5,503,609 A * 4/1996 Bull ..... A63B 23/0488 482/70
6,368,254 B1 * 4/2002 Wall ..... A63B 21/055 482/122
7,462,139 B2 * 12/2008 Stafiej ..... A63B 22/02 482/51
7,951,050 B2 * 5/2011 Raumann ..... A63B 22/0015 482/51
7,998,043 B2 * 8/2011 Zhou ..... A63B 21/154 482/139
8,944,970 B2 * 2/2015 Raumann ..... A61H 1/0259 482/51
9,079,071 B2 * 7/2015 Allain ..... A63B 21/023
9,586,089 B2 * 3/2017 Lagree ..... A63B 24/0075
9,630,056 B2 * 4/2017 Rao ..... A63B 71/0054
2001/0036885 A1 * 11/2001 Castellot, Jr. ..... A63B 21/012 482/79
2003/0119635 A1 * 6/2003 Arbuckle ..... A63B 22/0087 482/142
2008/0015095 A1 * 1/2008 Savsek ..... A63B 21/0455 482/121
2008/0248935 A1 * 10/2008 Solow ..... A63B 21/023 482/142
2009/0098983 A1 * 4/2009 Hoffman ..... A63B 21/055 482/70
2009/0105050 A1 * 4/2009 Mayo ..... A63B 21/06 482/70
2010/0248919 A1 * 9/2010 Zhou ..... A63B 21/154 482/139
2011/0039667 A1 * 2/2011 Teng ..... A63B 23/03541 482/142
2012/0108405 A1 * 5/2012 Milo ..... A63B 22/0087 482/142
2012/0244998 A1 * 9/2012 Rao ..... A63B 71/0054 482/70
2012/0277079 A1 * 11/2012 Allain ..... A63B 21/023 482/142
2012/0283079 A1 * 11/2012 Solow ..... A63B 21/0552 482/142
2014/0309091 A1 * 10/2014 Tang ..... A63B 21/0552 482/130
2015/0065311 A1 * 3/2015 Rao ..... A63B 71/0054 482/70
2015/0360083 A1 * 12/2015 Lagree ..... A63B 24/0075 482/130
2017/0087397 A1 * 3/2017 Lagree ..... A63B 21/0085
2019/0255375 A1 * 8/2019 Lagree ..... A63B 21/0085

* cited by examiner

PORTABLE EXERCISE APPARATUS COMPRISING RESISTANCE GENERATING MEMBER IN THE FORM OF A PLUNGER CARRIED ON LIMB RECEIVING MEMBER OF THE EXERCISE APPARATUS

This application is a Continuation-in-part application of U.S. patent application Ser. No. 15/918,118 filed Mar. 12, 2018, which claims the benefit under 35 U.S.C. 119(e) of U.S. Provisional application Ser. No. 62/592,133 filed Nov. 29, 2017.

FIELD OF THE INVENTION

The present invention relates generally to an exercise apparatus which is portable and which is particularly but not exclusively suited for leg exercise, and more particularly to such an exercise apparatus which is non-motorized so that the user employs manual human input to displace his/her limbs placed on the exercise apparatus.

BACKGROUND

In the field of exercise equipment, there are a variety of exercise apparatuses or devices particularly suited for leg exercises which, generally speaking, provide a pair of limb pads which are guided in reciprocating back-and-forth movement along tracks by an electric motor. As such, the movement of the limb pads is predetermined and occurs without conscious input from the user. Examples of such leg exercise equipment include that which is known under the trade name HappyLegs and LegXercise, each of which is a different machine marketed by a different manufacturer. They require an electrical outlet to receive power for operation and thus are not usable necessarily everywhere. Users of HappyLegs or LegXercise operate the equipment from a seated position. There is considerable inactivity associated with spending significant portions of time seated, which may cause leg/foot fatigue, swollen feet, cold feet, sore joints, and possibly blood clotting.

SUMMARY OF THE INVENTION

According to an aspect of the present invention there is provided an exercise apparatus comprising:

at least one track extending in a respective longitudinal direction from a first end of the at least one track to a second end thereof;

at least one limb receiving member defining a top surface for receiving a limb of a user and having first and second ends spaced apart in the respective longitudinal direction of the at least one track by a smaller distance than between the first and second ends of the at least one track;

the at least one limb receiving member being operatively coupled to the at least one track so as to be slidable relative thereto in a user-driven direction of sliding movement between the first end and the second end of the at least one track;

the at least one track comprising an upper load bearing surface respectively supporting the at least one limb receiving member in sliding contact therewith and a lower surface adapted for resting on a support surface;

a plunger including:

a housing mounted to one of the at least one track and the at least one limb receiving member so as to support the plunger;

a plunging member supported for movement relative to the housing in a plunging direction substantially parallel to the respective longitudinal direction of the at least one track;

an end surface defined by the plunging member which is oriented transversely to the plunging direction; and a biasing member interconnecting the plunging member and the housing and arranged to gradually resist movement of the plunging member in the plunging direction; and a stop surface which is oriented transversely to the plunging direction supported on the other one of the at least one track and the at least one limb receiving member at a location thereon which is in alignment with the end surface of the plunging member relative to the respective longitudinal direction of the at least one track;

the stop surface facing the end surface of the plunging member so as to be presented for contacting the end surface of the plunging member in a manner such that the plunging member is displaced in the plunging direction so as to provide gradual resistance to the sliding movement of said at least one limb receiving member in the user-driven direction.

Preferably, the plunger is mounted on the at least one limb receiving member and the stop surface is supported on the at least one track.

In the illustrated arrangement, the plunger comprises a pair of the end surfaces which are disposed in longitudinally opposite relation to one another each facing in an opposite direction towards one of the first and second ends of the at least one track, and wherein there is provided a pair of the stop surfaces each disposed at or adjacent one of the first and second ends of the at least one track. Thus, a single plunger mounted on a limb receiving member is operable to provide resistance at each end of the track when the user-driven direction of sliding movement of the limb receiving member is to toggle or flip.

In the illustrated arrangement, the pair of the end surfaces are carried on distinct plunging members which are movable independently of one another in respective plunging directions, the distinct plunging members being connected to and biased against movement in the respective plunging direction by the biasing member which is common thereto. Thus is provided a relatively simple arrangement of plunger.

In one arrangement, the stop surface is supported in fixed relation to said one of the at least one track and the at least one limb receiving member on which the stop surface is supported. For example, the stop surface may be formed from a rigid material.

Preferably, the plunging member is resiliently depressible in the plunging direction.

According to another aspect of the present invention there is provided an exercise apparatus comprising:

at least one track extending in a respective longitudinal direction from a first end of the at least one track to a second end thereof, the at least one track including first and second sides spanning between the first and second ends;

at least one limb receiving member defining a top surface for receiving a limb of a user and having first and second ends spaced apart in the respective longitudinal direction of the at least one track by a smaller distance than between the first and second ends of the at least one track;

the at least one limb receiving member being operatively coupled to the at least one track so as to be slidable relative thereto in a user-driven direction of sliding movement between the first end and the second end of the at least one track;

the at least one track comprising an upper load bearing surface respectively supporting the at least one limb receiving member in sliding contact therewith and a lower surface adapted for resting on a support surface;

a resistance generating member mounted on the at least one limb receiving member so as to be movable therewith, the resistance generating member being disconnected from the at least one track and arranged for releasable contact therewith at predetermined longitudinal locations of the at least one limb receiving member along the at least one track for generating at said predetermined locations resistance to the sliding movement of said at least one limb receiving member in the user-driven direction.

In the illustrated arrangement, the resistance generating member comprises a plunger which is depressible in a plunging direction substantially parallel to the respective longitudinal direction of the at least one track, the plunger defining an end surface which is oriented transversely to the plunging direction and which is movable relative to the at least one limb receiving member upon depression of the plunger; and there is provided a stop surface oriented transversely to the plunging direction and supported on the at least one track at a location thereon which is in alignment with the end surface of the plunger relative to the respective longitudinal direction of the at least one track, the stop surface facing the end surface of the plunger.

In one arrangement, the plunger comprises a pair of the end surfaces which are disposed in longitudinally opposite relation to one another each facing in an opposite direction towards one of the first and second ends of the at least one track, and wherein there is provided a pair of the stop surfaces each disposed at or adjacent one of the first and second ends of the at least one track.

In one arrangement, each one of the pair of the end surfaces are carried on a distinct member of the plunger which is displaceable in a direction parallel to the plunging direction, the distinct members which carry the end surfaces of the plunger being biased against displacement in said direction parallel to the plunging direction by a common biasing member.

In the illustrated arrangement, the stop surface is supported in fixed relation to said one at least one track.

Preferably, the plunger is resiliently depressible.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
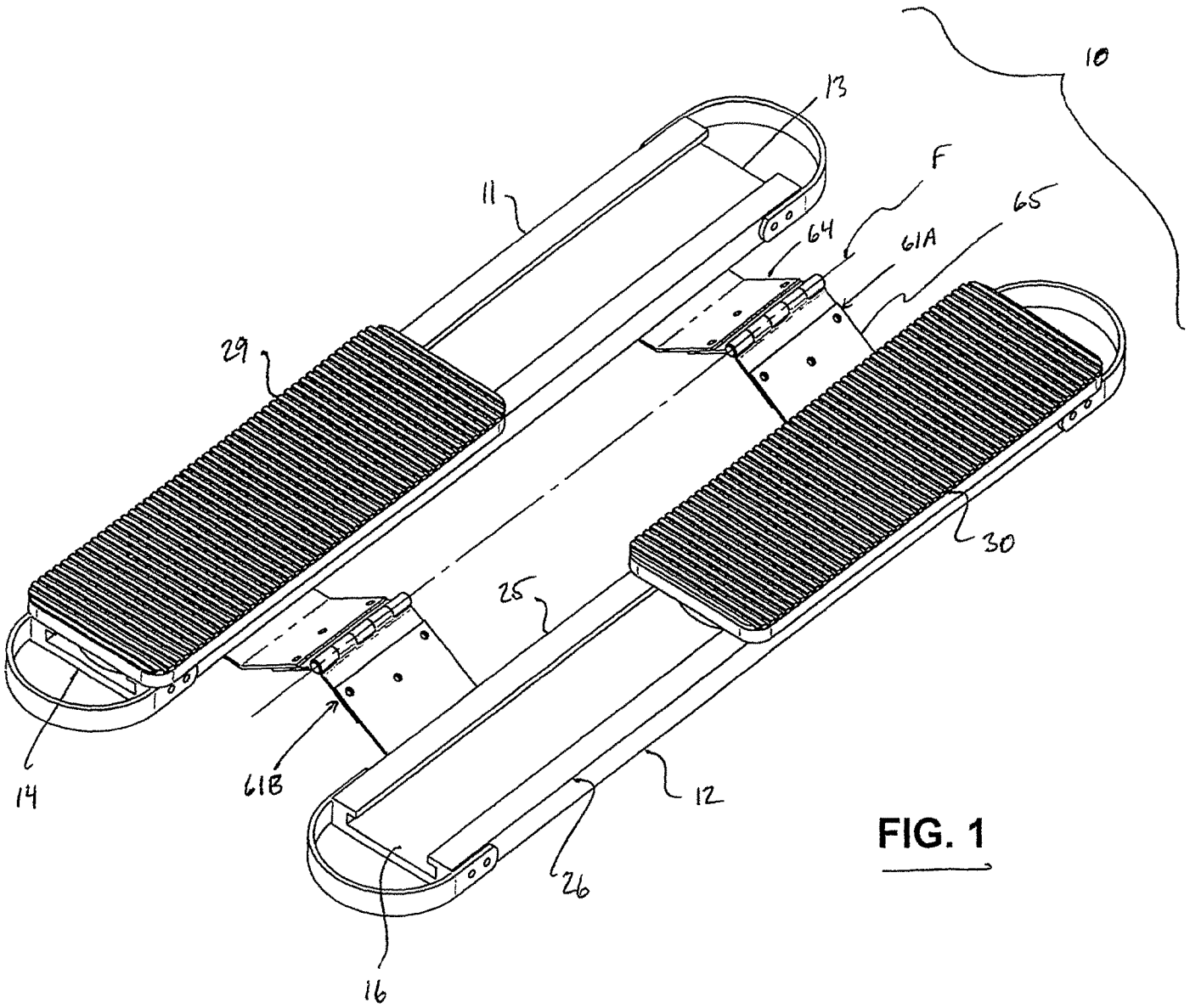
FIG. 1 is a perspective view of an arrangement of exercise apparatus.

The accompanying figures show an exercise apparatus 10 which is particularly but not exclusively suited for use in an exercise in which feet of a user (not shown) are placed on the apparatus and each displaced in reciprocating linear movement along the apparatus, as will be described in more detail shortly. It is possible that the exercise apparatus may be used in a manner instead receiving hands of a user for movement thereof in the reciprocating linear fashion.

Regardless of how the apparatus is intended to be used, the apparatus 10 comprises a pair of tracks 11 and 12 which are linearly elongated in a respective longitudinal direction of each track and thus each extends linearly from a first end 13 to a second end 14. In the illustrated arrangement of FIGS. 1-5, the tracks are in the form of channels with a bottom base wall 16 defining a planar upper load bearing surface 17 and a lower surface 18 which is adapted for resting on a support surface, for example by being shaped flat and planar or by a plurality of feet (not shown) carried in spaced relation on the lower surface 18. The tracks are open at opposite longitudinally spaced-apart ends 13 and 14 and comprise side walls 25 and 26 upstanding from the base wall 16 defining laterally opposite sides of the tracks.

The exercise apparatus 10 further includes a pair of limb receiving members in the form of pads 29 and 30 which are operatively coupled to the tracks 11 and 12 so as to be slidable relative thereto between the first and second ends 13, 14. Each pad 29, 30 comprises a coupling portion 31 (shown in stippled line) which is arranged for coupling to the tracks, and an upper portion 32 which carries at its top a support surface 32A for receiving a limb of a user, for example a foot or a hand.

In the first illustrated arrangement of FIGS. 1-4, the side walls of the respective track comprise interior side surfaces 33 which extend vertically upwardly from the upper load bearing surface 17 of the base channel wall. At a top of each side wall 25, 26 there is provided a retaining portion 35 which extends inwardly towards a (imaginary) longitudinally extending center line 36 of the respective track such that there is defined at a bottom of the retaining portion 35 a horizontal surface which meets the interior side surface 90 at a right angle.

Thus the coupling portion 31 comprises an enlarged base 38 (shown in phantom) spanning a majority of the interior width of the track between opposite interior side surfaces 33 and defining a bottom surface 38A which is in sliding contact with the load bearing surface 17 of the track.

The coupling portion further includes a neck 41 which is narrower in width than the base 38 so as to fit between vertically upright inner side surfaces 44 of the retaining portions of the track side walls.

Thus in the first illustrated arrangement, the pads 29, 30 are operatively coupled to the tracks 11, 12 by cooperating interlocking shapes which prevent each pad from being lifted upwardly out of the channel defined by the respective track.

The upper portion 32 of the respective limb pad extends in a width direction, transverse to the longitudinal direction of the track, beyond the neck 41 and beyond the base 38 so as to form the widest part of the limb pad. Thus the upper portion comprises bottom surfaces 45 which can come into sliding contact with upper surfaces 46 of the side walls of the track.

Each sliding interface between the respective pad and track comprises low-friction material, such as silicone, in a film or layer across each surface, and that portion thereof, defining the interface so as to allow the pad to slide freely along the track. Thus in some arrangements where the bottom surfaces 45 of the upper support portion 32 of the respective are in sliding contact with the upper surfaces 46 of the track side walls 25, 26 there may be low-friction material at this interface between these two types of surfaces.

At each open end of the track there is provided an elastic band 49 coupled at either side thereof to an outer surface of each side wall 25, 26 of the track so as to span from one side of the track to the other and span a full width between the interior side surfaces 33 between which the base 38 of the limb pad extends.

The elastic band 49 comprises a thin strip of rubber material oriented vertically upright so as to define a vertically upright inner band surface 51 facing towards the proximal and adjacent open end 13 or 14 of the track and thus communicated with a sliding area of the track defined over or vertically above the upper load bearing surface 17 where the limb pad is carried by the track in sliding movement therealong. The inner band surface 51 is vertically upstanding relative to the load bearing surface 17 of the track and extends above the load bearing surface to a top edge 54 spaced above this surface. In other words, the inner band surface extends from the top edge 54 downwardly towards the upper load bearing surface 17 so as to be upstanding relative thereto.

In the first illustrated arrangement the whole of the elastic band 49 follows a convex arcuate path from the first side to the second side of the track relative to the longitudinal direction thereof, such that the inner band surface 51 follows same.

The elastic band 49 is resiliently deformable in the longitudinal direction of the track so that upon contact with an end 57, 58 of the limb pad the band 49 acts to stretch away from the proximal end 13 or 14 of the track providing gradual resistance to the limb pad still being displaced longitudinally in that direction, until the band can no longer stretch so as to define a limit in the sliding range of movement of the limb pad.

An elastic band is provided at either end 13, 14 of the track to provide the gradual resistance and braking of the sliding movement of the respective limb pad and to define a limit in this movement at both ends of the track.

The enlarged base 38 of the respective limb pad's coupling portion is sized slightly larger in length in the longitudinal direction of the respective track than the neck 41, and thus although the top edge 54 is located above a top of the enlarged base including a top edge and top surface of the enlarged base, it is the base 38 of the limb pad's lower coupling portion which defines the end 57, 58 of the limb pad that contacts the inner band surface 51. As such both ends 57, 58 of the enlarged base 38 are curved convexly relative to the respective longitudinal direction of the track to which the respective pad is coupled so as to substantially conform to the shape of the inner band surface 51.

The upper portion 32 of each pad is substantially rectangular shaped in plan view and extends not only in the width direction but also in the length direction beyond ends 57, 58 of the enlarged base of the respective pad.

In the illustrated arrangements both limb pads 29, 30 freely slide along the tracks and are not driven by any motor. Thus there is no power source for connecting to in order to operate the apparatus 10, rather the limb pads are displaced by manual input from the user to move his/her feet in the reciprocating linear movement defined by the shape of the tracks.

Thus the apparatus is suited for use anywhere and to be portable as it does not require a power source to enable the sliding movement of the limb pads.

So as to further enhance portability of the apparatus 10, the tracks are interconnected by a foldable bridging portion 61 spanning from an inner one 25 of the sides of a first track 11 to an inner one of the sides of a second track 12.

The bridging portion 61 comprises in the illustrated arrangements two sets 61A and 61B of frame members interconnecting the tracks 11, 12 at longitudinally spaced positions relative to the tracks. Each set of frame members 61A, 61B includes a pair of brackets 64, 65 which in the illustrated arrangements are respectively connected to the lower surface 18 of the base wall of the respective track and extend perpendicularly transversely from connection to the base wall in a laterally inward direction towards the opposite track which in an operating position of the apparatus is arranged so that the top limb-receiving surfaces 32A of the limb pads are coplanar, as more clearly shown in FIG. 2.

Figure 5:
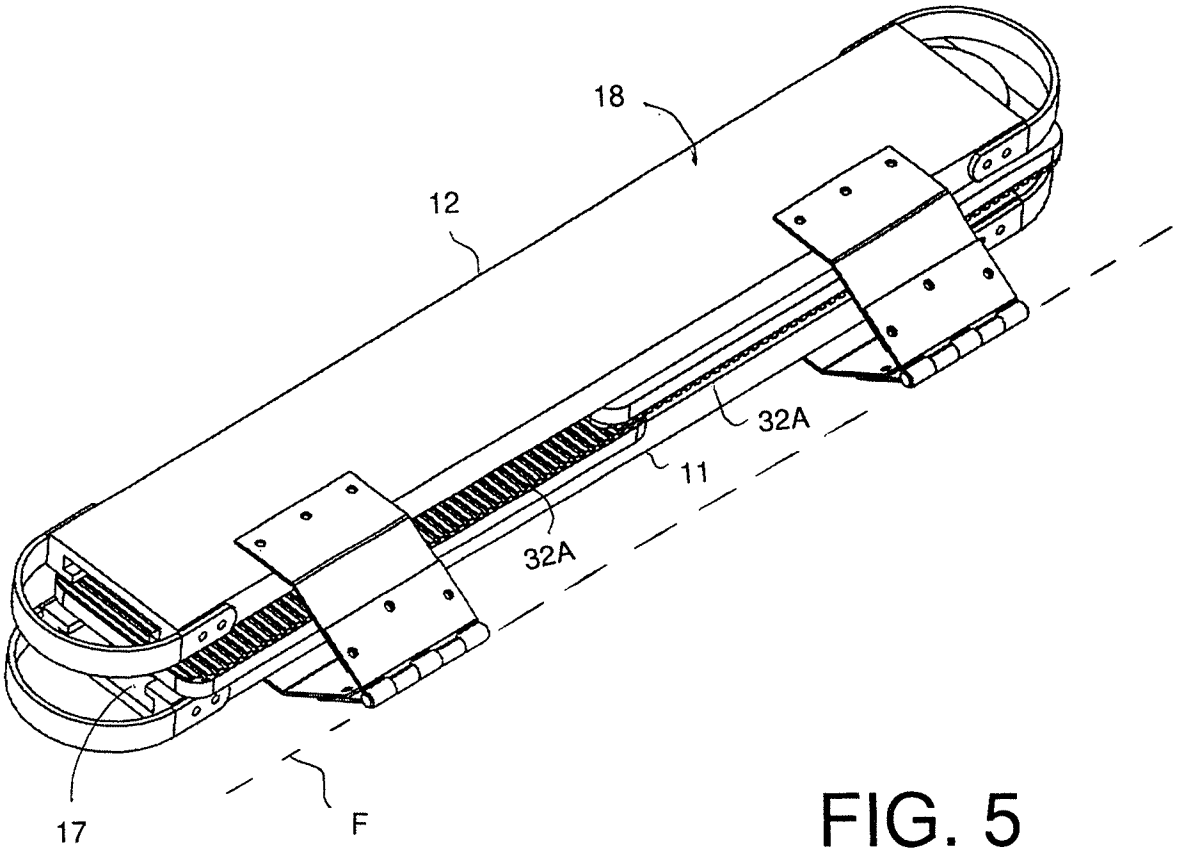
FIG. 5 is a perspective view of the arrangement of FIG. 1 disposed in a storage position.

In either the operating position as shown in FIG. 1, for example, or a storage position of the exercise apparatus which is shown in FIG. 5 and which will be discussed in more detail shortly, the pair of tracks 11, 12 are mounted to the frame members so as to be wholly oriented parallel to one another, since each track is linearly elongated. Thus the tracks are oriented relative to one another such that the respective longitudinal directions of the tracks are parallel to one another.

Each pair of brackets 64, 65 of each set of frame members 61A, 61B are interconnected by a hinge 68 which define a common folding axis F oriented parallel to each one of the respective longitudinal directions of the tracks and to the tracks themselves, which are linearly elongated along a respective longitudinal axis indicated at 36. As such the tracks 11, 12 are movable relative to one another in pivotal movement about the folding axis F between the operating position and the storage position. In the operating position, the tracks 11, 12 are located in spaced relation from one another relative to the transverse direction which is crosswise to the respective longitudinal directions of the tracks such that inner sides 25 of the tracks are spaced from one another in the transverse direction, and the folding axis F is located centrally halfway between the tracks with respect to the transverse direction. In the storage position as shown in FIG. 5, the tracks 11, 12 are disposed with the upper load bearing surfaces 17 oriented so as to face one another so that the top limb-receiving surfaces 32A of the pads can be brought to touch if the pads are located at longitudinally coinciding positions along the tracks, and the folding axis F is located transverse outwardly from the tracks 11, 12. In the storage position of other arrangements, the tracks are displaced about the folding axis such that their lower surfaces 18 are oriented so as to generally face one another.

Figure 2:
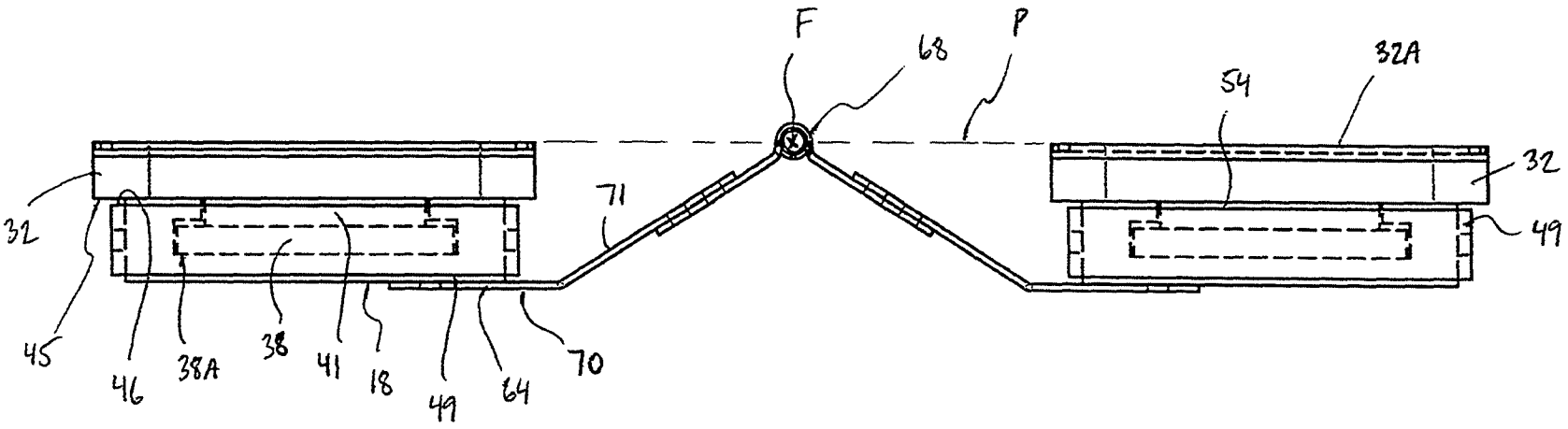
FIG. 2 is a top plan view of the arrangement of FIG. 1.
Figure 3:
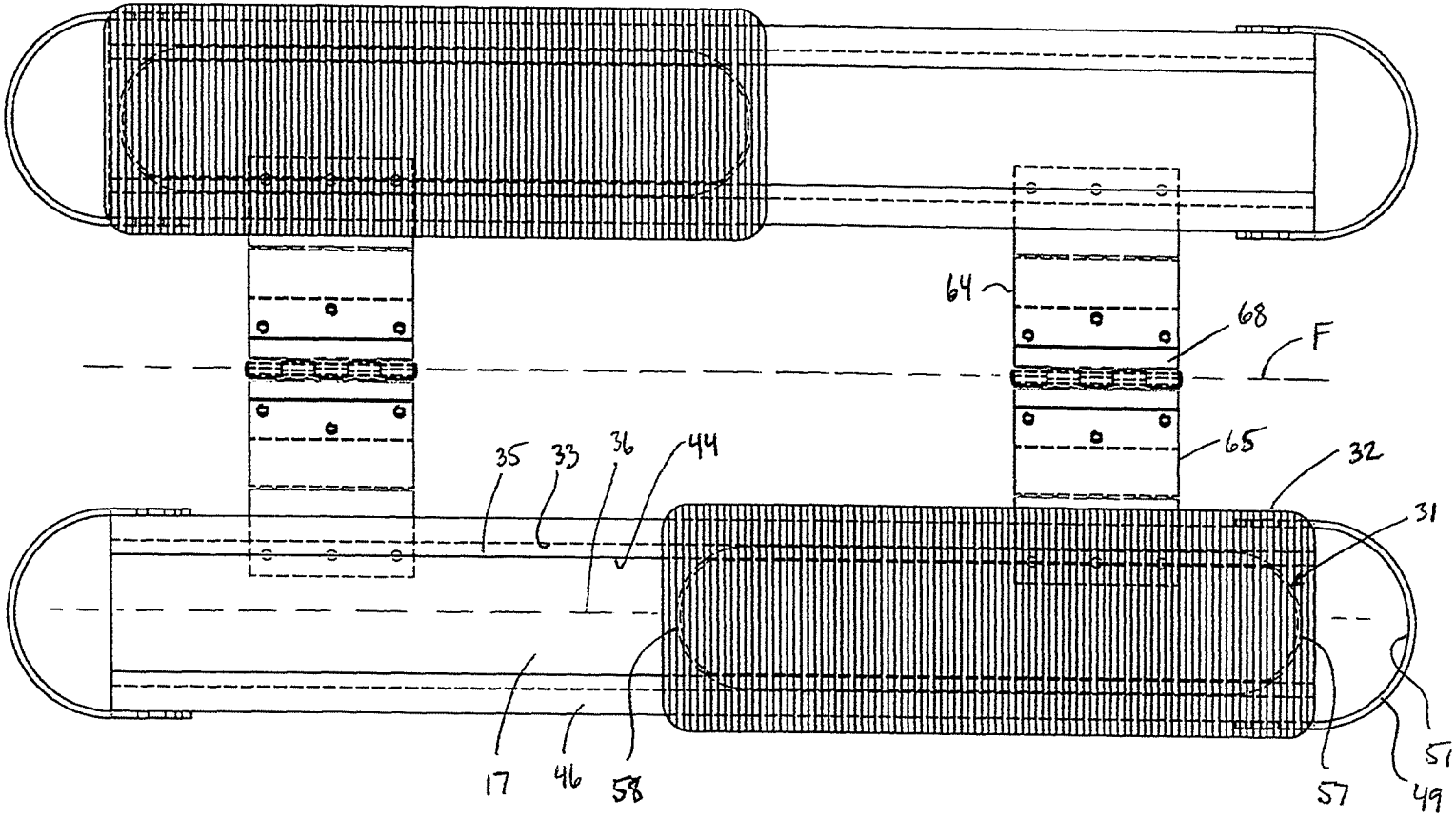
FIG. 3 is a side elevational view of the arrangement of FIG. 1.
Figure 4:
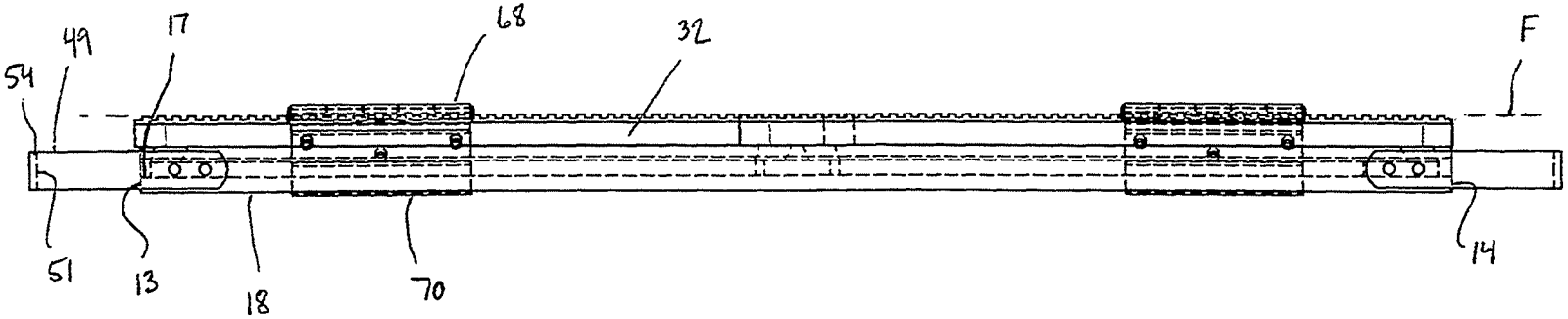
FIG. 4 is an end view of the arrangement of FIG. 1.

As more clearly shown in FIG. 2, the pair of hinges 68 are each located at a height spaced above the lower surface 18 of the tracks so as to locate in the operating position the common folding axis F defined by the hinges at a height where the axis F lies in a common plane P with the top limb-receiving support surfaces 32A of the pads 29, 30. Thus the exposed top surfaces 32A of the pads can be arranged flat against each other in the storage position of the apparatus. That is, in the storage position the folding axis lies in a plane lying in between the top surfaces 32A of either pad. In order to locate the folding axis F coplanar with the exposed limb-receiving surfaces 32A of the pads, each bracket 64, 65 mounted to the lower surface 18 of the respective track has a planar horizontal portion 70 generally parallel to the planar lower surface 18 of that track and then a planar inclined portion 71 which is inclined relative to the horizontal bracket portion 70 upwardly and inwardly towards the opposite track. It is to this inclined bracket portion 71 that the hinge is mounted.

Figure 6:
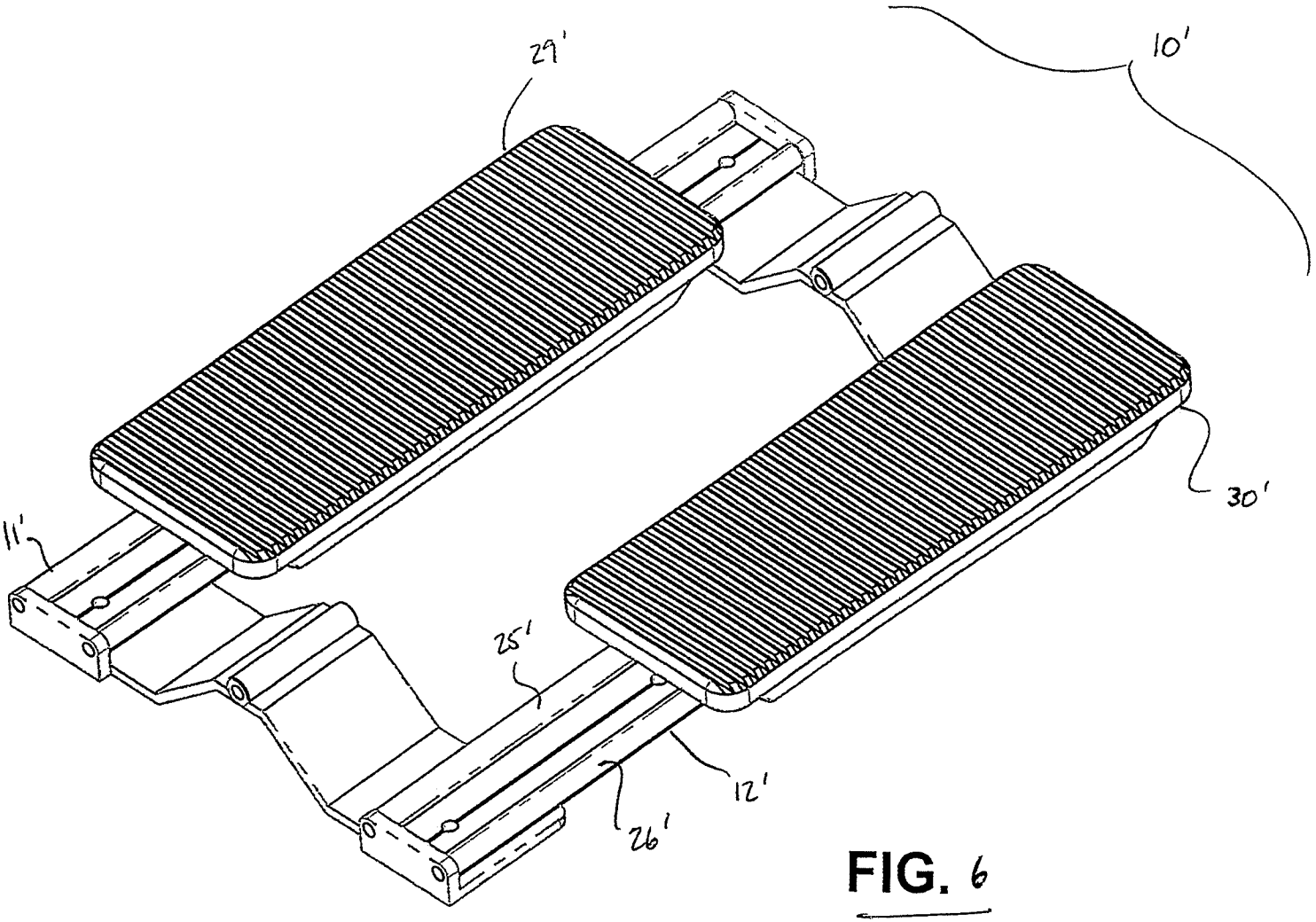
FIG. 6 is a perspective view of another arrangement of exercise apparatus.
Figure 7:
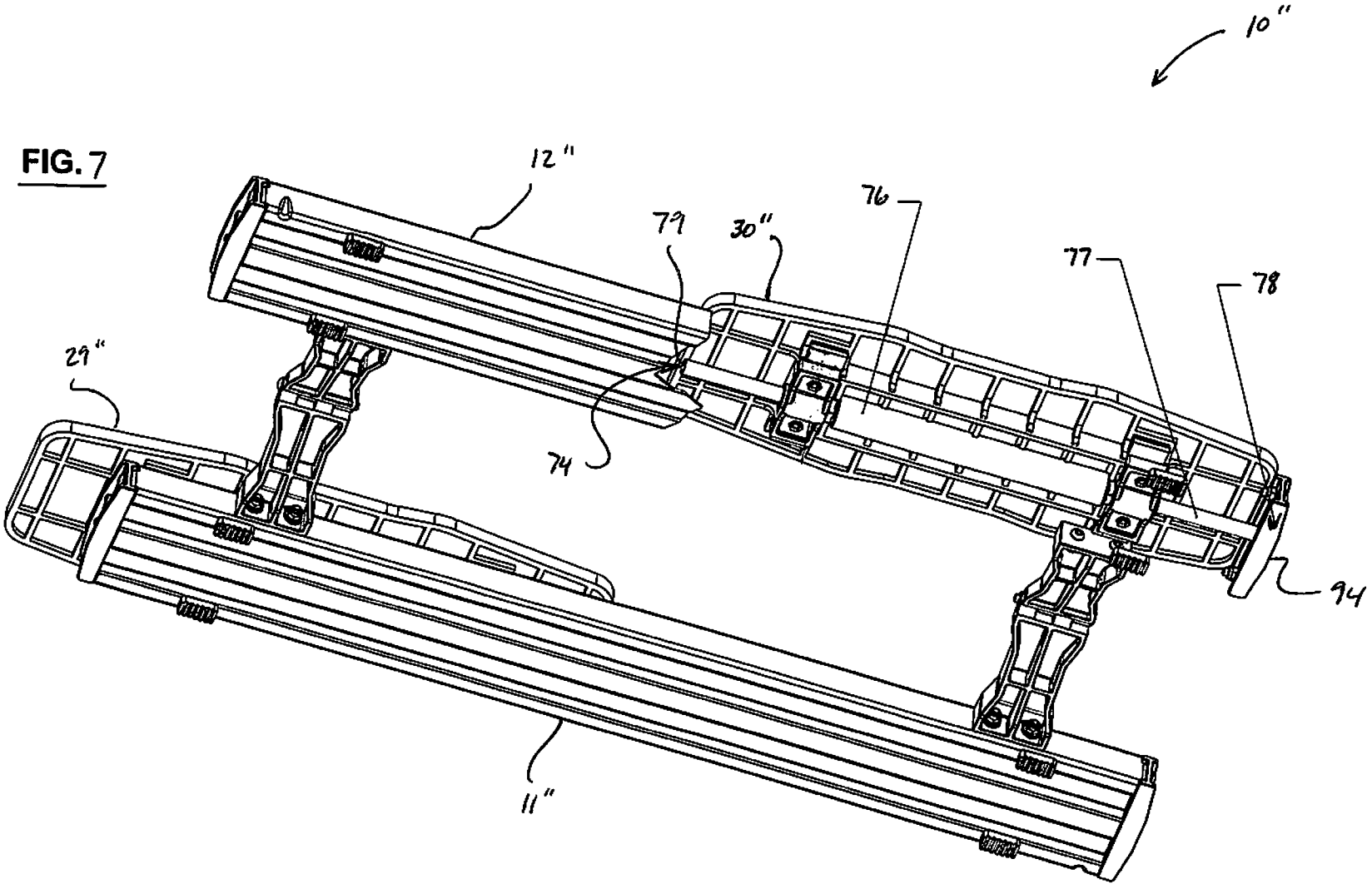
FIG. 7 is a bottom perspective view of yet another arrangement of exercise apparatus which is in accordance with the present invention, where a portion of a track is cutaway for convenient illustration.

Referring now to FIG. 6, this figures illustrates another arrangement of apparatus 10' which excludes the elastic bands 49 of the first arrangement 10 and which employs a different track structure 11', 12' and consequently limb support members which have coupling portions of a different structure to cooperate with the tracks 11', 12'. In the arrangement of FIG. 6, the respective track includes a base wall 16' with a pair of cylindrical side walls 25', 26' on which a pair of blocks with cylindrical bores are slidingly mounted, defining the coupling portion 31' of the pads 29', 30'. Thus the upper load bearing surfaces of the second arrangement are defined on tops of the cylindrical side walls 25', 26'. A remainder of the second arrangement 10' is substantially similar to the first arrangement 10 described in detail hereinbefore.

Figure 8:
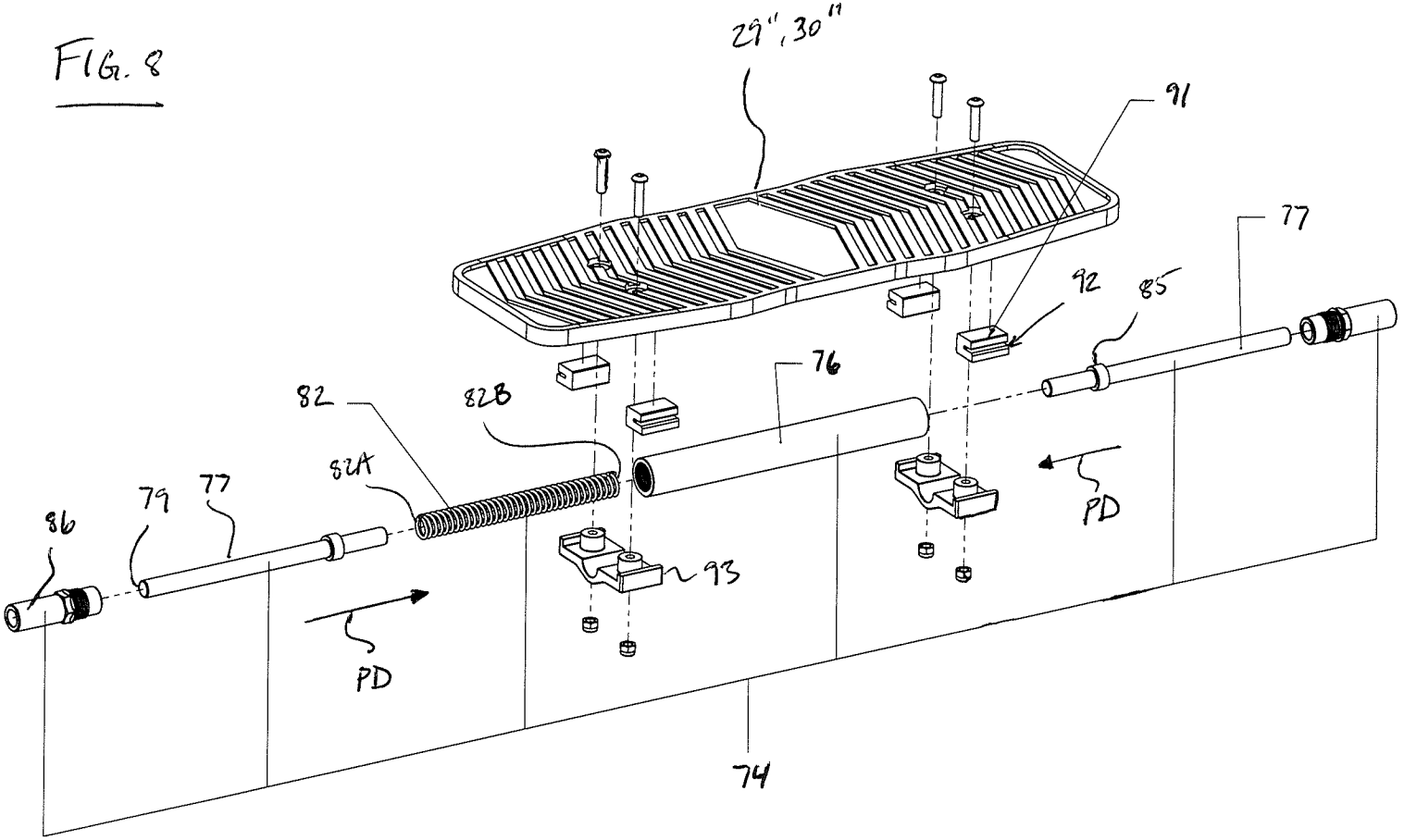
FIG. 8 is an exploded view of resistance generating member of the arrangement of FIG. 7.

FIGS. 7-12 show yet another arrangement of exercise apparatus 10" with a resistance generating member for generating resistance to the sliding movement of the limb receiving member 29", 30" in the user-driven direction, before the direction of movement is toggled or flipped to the opposite direction, that is in the form of a plunger 74. The plunger 74 comprises a housing 76 receiving therein at least one plunging member 77 which is supported for movement relative to the housing 76 in a respective plunging direction PD substantially parallel to the respective longitudinal direction of the respective track 11" or 12". The housing 76 is mounted to the respective track 11", 12" or the respective limb receiving (or limb support) member 29" or 30" so as to support the plunger 74 thereon. In the illustrated arrangement, the plunger 74 is mounted on the respective limb support member so as to be movable therewith. The plunger 74 interacts with a stop surface 78 supported on the other of the track or the limb receiving member on which the plunger 74 is not mounted. Referring to FIG. 8, each plunging member 77 defines a contactable end surface 79 at an exposed end thereof located externally of the housing 76. The end surface 79 is oriented transversely to the plunging direction PD and faces away from the respective plunging direction PD of the particular plunging member 77.

Figure 9:
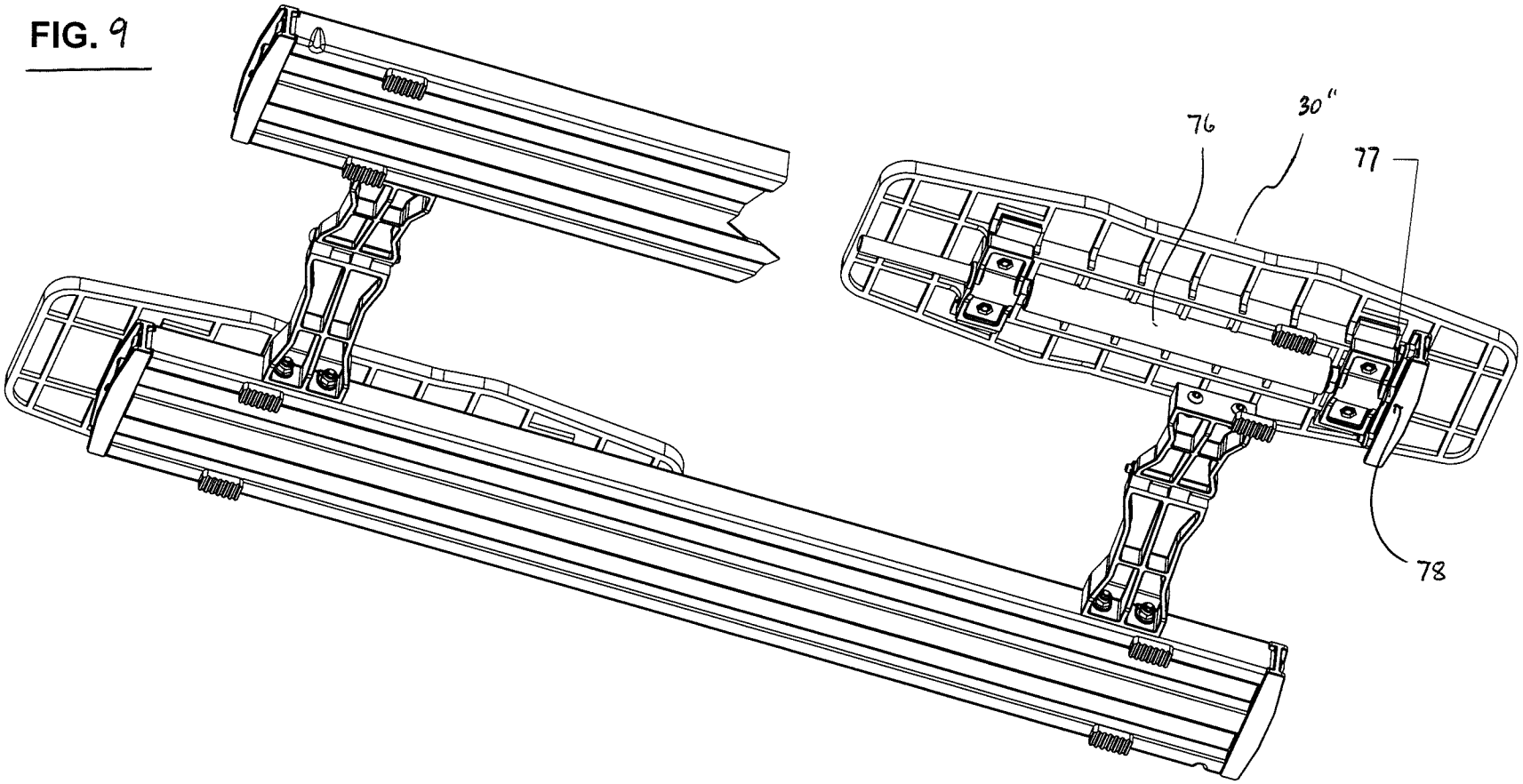
FIG. 9 is another bottom perspective view similar to FIG. 7 showing depression of the resistance generating element against a stop surface.
Figure 10:
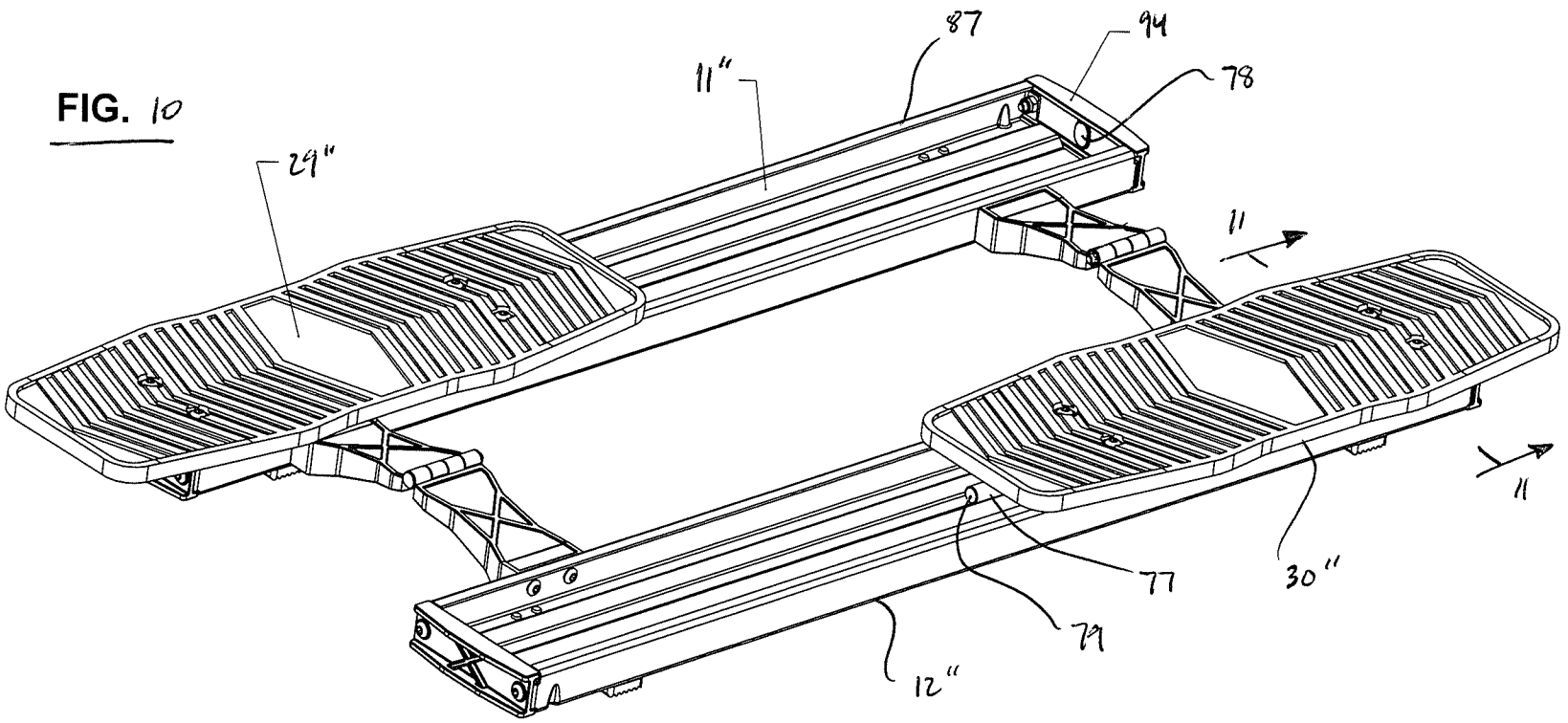
FIG. 10 is a top perspective view of the arrangement of FIG. 7.
Figure 11:
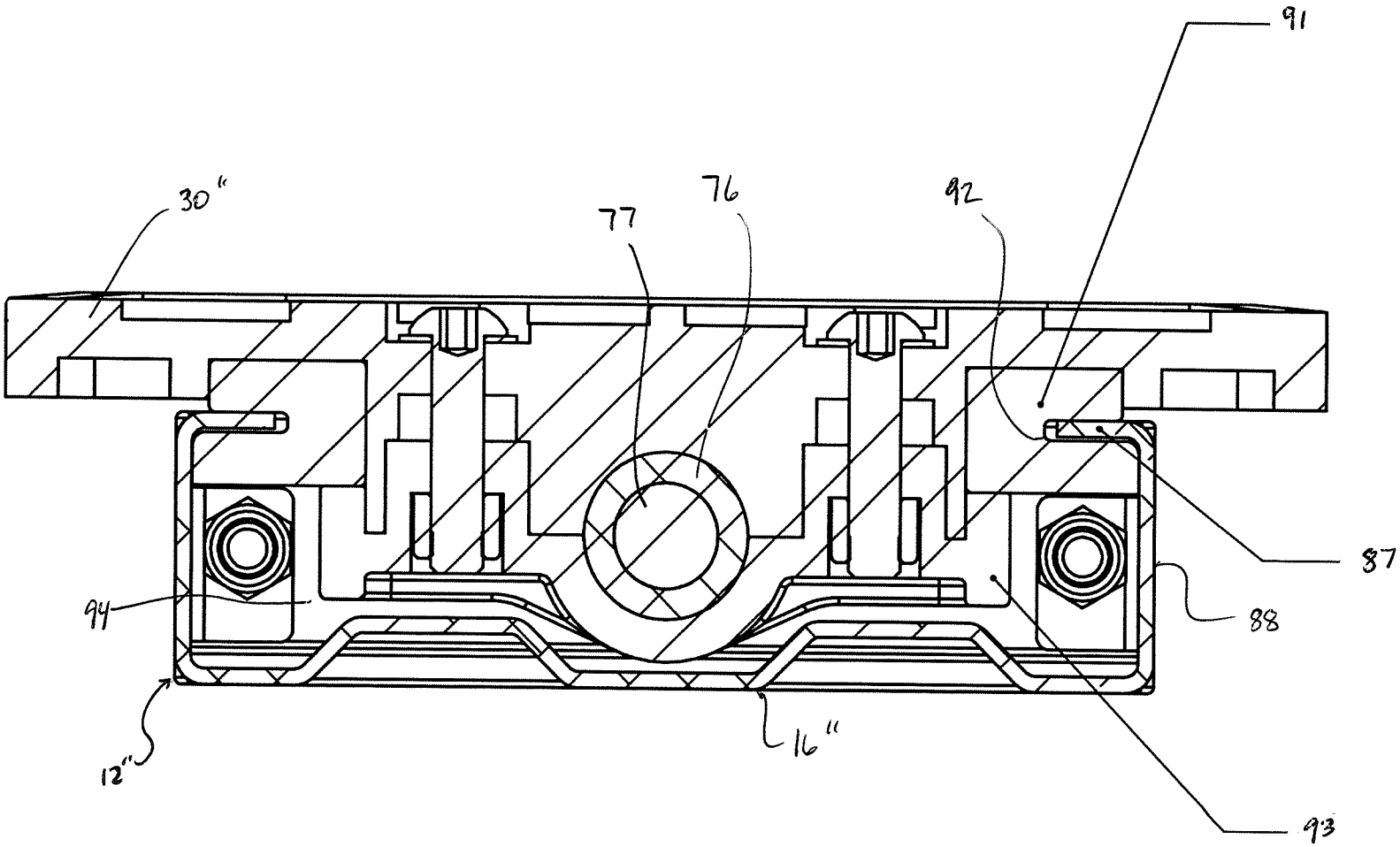
FIG. 11 is a cross-sectional view along line 11-11 in FIG. 10.

The plunger 74 further includes a biasing member 82 interconnecting the respective plunging member 77 and the housing 76, and which is arranged to gradually resist movement of the respective plunging member 77 in the respective plunging direction PD. In the illustrated arrangement, the biasing member 82 comprises a compression spring or a damper. Furthermore, the biasing member 82 is adapted so that the plunging members 77 are resiliently depressible in their corresponding plunging directions which are opposite to one another. That is. after any one of the plunging members 77 is displaced in the respective plunging direction PD so as to be depressed relative to the housing 76 as shown in FIG. 9 (i.e., located deeper within the housing 76 than in its normal projecting condition in which the end surface 79 awaits contact with the stop surface 78), the biasing element 82 biases the respective plunging member 77 back to its starting position as for example shown in FIG. 7 in which the end surface 79 is located at a prescribed distance beyond the housing 76.

In further regard to the third illustrated arrangement 10" of FIGS. 7-12, the plunger 74 comprises a pair of the end surfaces 79 disposed in longitudinally opposite relation to one another and each end surface of the pair facing in an opposite direction towards one of the first and second ends of the track. Accordingly, there is provided a pair of the stop surfaces 78 each disposed at or adjacent one of the first and second ends of the respective track. Thus, a single plunger 74 mounted on a limb receiving member is operable to provide resistance at each end of the track when the user-driven direction of sliding movement of the limb receiving member is to toggle or flip.

Each contactable end surface 79 of the plunger is carried on a distinct plunging member as more clearly shown in FIG. 8 which is movable independently of the other in its respective plunging direction PD which is opposite to that of the other plunging member. The distinct plunging members 77 are connected to and biased against movement in the respective plunging direction by the biasing member 82 which is common thereto. Thus is provided a relatively simple arrangement of plunger.

As already mentioned, there is provided for cooperation with the plunger 74 at least one stop surface 78 which is oriented transversely to the respective plunging direction of the plunging member 77 opposite thereto. Furthermore, the respective stop surface 78 is disposed at a location thereon which is in alignment with the end surface 79 of the opposite plunging member 77 in relation to the respective longitudinal direction of the respective track 11", 12". The respective stop surface 78 faces the end surface 79 of the respective plunging member 77 so as to be presented for contacting the same in a manner such that the respective plunging member 77 is displaced in its plunging direction PD so as to provide gradual resistance to the sliding movement of the corresponding limb receiving member being displaced in the user-driven direction. In the illustrated arrangement, the stop surfaces 78 are supported on the tracks 11", 12".

As such, the plunger 74 which acts to generate a force resistive to the sliding movement is disconnected from the tracks; however, the plunger 74 is arranged for releasable contact with the respective track, to which its carrier limb support member is slidably coupled, at predetermined longitudinal locations of said carrier along the corresponding track for generating at these predetermined locations resistance to the sliding movement of the limb support member in the user-driven direction. In the illustrated arrangement, these predetermined locations are the ends of each track.

As most clearly shown in FIG. 8, the plunger 74 of the illustrated arrangement 10" comprises a tubular circular cylindrical housing 76 which is open at either end and oriented so as to extend in the respective longitudinal direction of the track 11", 12" to which the carrier limb support member 29", 30" is coupled. The tubular housing 76 wholly receives biasing member 82 which extends substantially coaxially of the tubular housing 76. The biasing member 82 which in the illustrated arrangement is substantially tubular in shape receives at each end thereof an inner portion of the respective plunging member 77 which is elongated in the respective longitudinal direction of the track. Each plunging member 77 defines at an intermediary location thereon a diametrically enlarged collar 85 which provides a circumferential abutment surface for butting engagement with the corresponding end 82A, 82B of the tubular biasing member 82. The remainder, outer portion of the respective plunging member 77 protrudes beyond the housing 76 and extends to the contactable end surface 79 available for depressible contact with the corresponding stop surface 78. In the illustrated arrangement, a distinct end cap bearing 86 attachable to the housing so as to be in communication therewith provides additional support for carrying the respective plunging member 77 in its movement into and out of the housing 76. Furthermore, it will be appreciated that the distinct plunging members 77 each carrying an end surface 79 facing in an opposite direction are biased against displacement in their corresponding plunging directions, or generally parallel to the plunging direction of the single plunger, by a common biasing member 82.

The plunger 74 is mounted on an underside of the respective limb support member 29", 30" so as to be located within the channel defined by the track 11", 12". As more clearly shown in FIGS. 8 and 11, the upper load bearing surface is therefore defined by tops of the track side walls 25", 26" which form flanges 87 protruding inwardly from upstanding portions 88 of the side walls so as to overly the base wall 16". Each limb receiving member 29", 30" includes a plurality of blocks 91 coupled to the underside thereof and defining slits 92 which open on outer sides of the blocks and mate with the flanges 87 so that the limb support member 29", 30" is slidably coupled to the track. The plunger 74 is supported under the respective limb receiving member by cradle-like brackets 93 disposed under the housing 76 and which sandwich the housing 76 to the underside of the limb receiving member.

The stop surfaces 78 are defined by rigid end caps 94 which close the channel at the otherwise open first and second ends of the track 11", 12". The stop surfaces 78 thus are formed from a rigid material which is not deformable and which is supported in fixed relation to the track, where it is supported.

Figure 12:
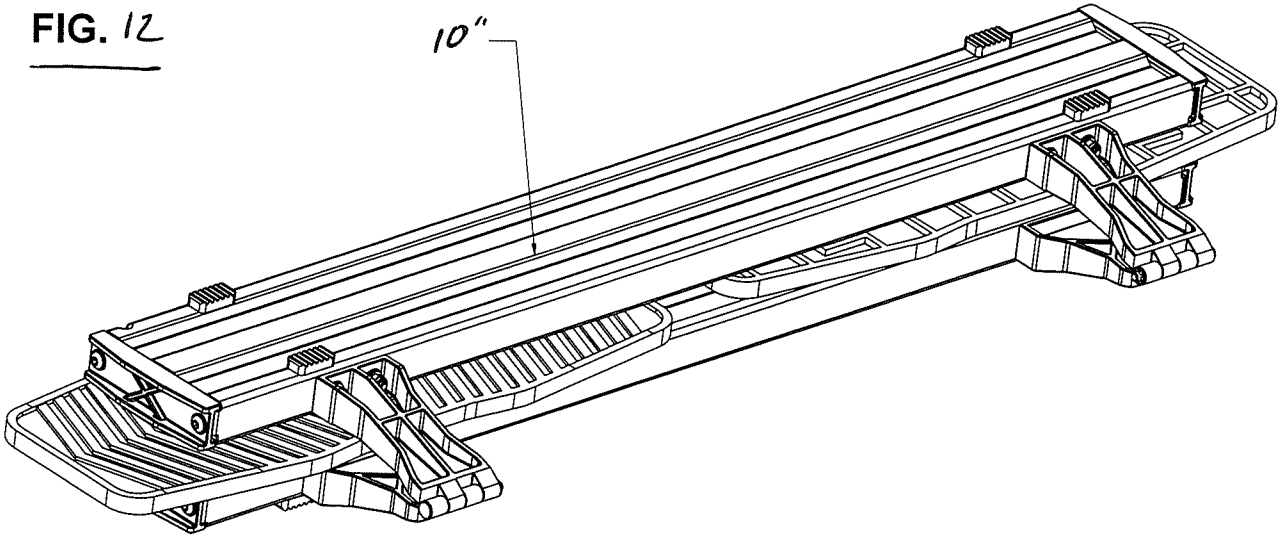
FIG. 12 is a perspective view of the arrangement of FIG. 7 arranged in a storage position.

FIG. 12 shows the third arrangement of exercise apparatus 10" in the folded storage position similar to what was described previously with more specific reference to the arrangements of FIGS. 1-6.

In use, the apparatus may be kept in the folded storage position in which the overall size of the apparatus is minimized until required for use. To move the apparatus from the storage position to the operating position, the tracks 11, 12 to which the limb receiving pads are coupled are manually moved apart from one another so as to swing each half of the apparatus about the common folding axis F into the operating position in which the tops 32A of the pads 29, 30 are coplanar. For use when arranged in the operating position the user places limbs, typically the feet, respectively onto the pads 29, 30 and proceeds to displace his/her feet along the tracks in the longitudinal directions thereof. When the respective pad reaches an elastic band, continuing displacement of the pan in the longitudinal direction towards the band acts to stretch the band away from the nearest end of the track. Once the band has been maximally stretched the limb pad cannot proceed in the same longitudinal direction any further, causing the user to displace his/her limb in the opposite direction along the track.

In the illustrated arrangements the hinge is not limited in its range of movement such that the tracks can be pivoted past the position where the tops 32A of the pads are coplanar, for example if the support surface beneath the apparatus is uneven.

The apparatus may enable the user to exercise their legs in a back and forth motion while sitting on a chair or on a bench, at a desk, or on an airplane or vehicle as a passenger. Thus exercises carried out on this apparatus may increase blood flow and heart rate to reduce leg/foot fatigue and reduce inactivity, particularly when an individual spends considerable time sitting whether for example at a desk or as a passenger in a motor vehicle or on an airplane.

In use of the third arrangement 10" illustrated in FIGS. 7-12, the user displaces the respective limb support member 29" or 30" along the respective track 11" or 12" until the end surface 79 of the respective plunging member 77 that is facing in the user-driven direction of the sliding movement of the limb support member engages the stop surface 78 opposite the leading end surface 79 (that is, leading relative to the user-driven direction). At this point of contact, the engaged plunging member 77 is displaced relative to the housing 76 in its respective plunging direction PD, so as to depress the plunger, as the user continues to displace their supported limb towards the end of track where the engaged stop surface 78 is located. Depression of the plunger acts to strain the biasing member 82 in an opposite direction to that in which it is biasing the depressed plunging member, which is opposite to the plunging direction PD of that member 77 which has now been depressed. Sliding movement of the limb support member continues until the engaged plunging member 77 is fully depressed, which act (full depression of the plunging member) defines a limit of the sliding movement from initial point of contact that is based on a stroke of the plunging member in its depressive movement into the housing 76. To continue the sliding movement, the user proceeds to displace the limb supporting member 29" or 30" in the opposite direction, and the plunger 78 is engaged and provides gradual resistance to the sliding movement in this new direction upon contact of the opposite, available end surface 79 with the stop surface 78 at the opposite end of the track.

As described herein, the exercise apparatus generally comprises: a pair of tracks each extending in a respective longitudinal direction from a first end of a respective one of the tracks to a second end thereof, each one of the tracks including an inner side and an outer side each spanning from the first end to the second end of the respective one of the tracks; a pair of limb receiving members defining top support surfaces for receiving limbs of a user and each having first and second ends spaced apart in the respective longitudinal direction of the pair of tracks by a smaller distance than between the first and second ends of the respective one of the pair of tracks; the pair of limb receiving members each being operatively coupled to the respective one of the pair of tracks so as to be slidable relative thereto between the first end of the respective one of the tracks and the second end thereof; the pair of tracks comprising upper load bearing surfaces supporting the limb receiving members and lower surfaces adapted for resting on a support surface in an operating position of the exercise apparatus; the pair of tracks being oriented substantially parallel to one another such that the respective longitudinal directions of the tracks are oriented substantially parallel to one another; the pair of tracks being interconnected by a bridging portion which spans from the inner side of one of the tracks to the inner side of the other one of the tracks; the bridging portion comprising a hinge defining a folding axis oriented substantially parallel to each one of the respective longitudinal directions of the tracks so that the tracks are movable between the operating position in which the pair of tracks are located in spaced relation from one another with respect to a transverse direction which is cross-wise to the respective longitudinal directions of the pair of tracks such that the inner sides of the tracks are spaced from one another in the transverse direction and the folding axis is located centrally between the tracks with respect to the transverse direction, and a storage position in which the tracks are disposed with the upper load bearing surfaces or the lower surfaces facing one another and the folding axis is located transversely outwardly from the pair of tracks.

Additionally and/or alternatively, as described herein the exercise apparatus generally comprises: at least one track extending in a respective longitudinal direction from a first end of the at least one track to a second end thereof, the at least one track including first and second sides spanning between the first and second ends; at least one foot receiving member defining a top surface for receiving a limb of a user and having first and second ends spaced apart in the respective longitudinal direction of the at least one track by a smaller distance than between the first and second ends of the at least one track; the at least one limb receiving member being operatively coupled to the at least one track so as to be slidable relative thereto between the first end and the second end of the at least one track; the at least one track comprising an upper load bearing surface respectively supporting the at least one limb receiving member and a lower surface adapted for resting on a support surface; an elastic band spanning from the first side to the second side of the at least one track at or adjacent one of the first and second ends of the at least one track, the elastic band having a top edge spaced above the upper load bearing surface and an inner band surface extending from the top edge downwardly so as to be upstanding relative to the upper load bearing surface; the inner band surface being communicated with a sliding area defined over the upper load bearing surface of the at least one track so as to be adapted for engaging one of the first end of the at least one limb receiving member and the second end thereof; the elastic band being resiliently deformable in the respective longitudinal direction of the at least one track which is transverse to the inner band surface, so as to provide gradual resistance to sliding movement of the limb receiving member in the respective longitudinal direction upon contact with the inner band surface of the elastic band.

The scope of the claims should not be limited by the preferred embodiments set forth in the examples but should be given the broadest interpretation consistent with the specification as a whole.

The invention claimed is:

1. An exercise apparatus comprising:

at least one track extending in a respective longitudinal direction from a first end of the at least one track to a second end thereof;

at least one limb receiving member defining a top surface for receiving a limb of a user and having first and second ends spaced apart in the respective longitudinal direction of the at least one track by a smaller distance than between the first and second ends of the at least one track;

the at least one limb receiving member being operatively coupled to the at least one track so as to be slidable relative thereto in a user-driven direction of sliding movement between the first end and the second end of the at least one track;

the at least one track comprising an upper load bearing surface respectively supporting the at least one limb receiving member in sliding contact therewith and a lower surface adapted for resting on a support surface;

a plunger including:

a housing mounted to one of the at least one track and the at least one limb receiving member so as to support the plunger;

a plunging member supported for movement relative to the housing in a plunging direction substantially parallel to the respective longitudinal direction of the at least one track;

an end surface defined by the plunging member which is oriented transversely to the plunging direction; and a biasing member interconnecting the plunging member and the housing and arranged to gradually resist movement of the plunging member in the plunging direction; and a stop surface which is oriented transversely to the plunging direction supported on the other one of the at least one track and the at least one limb receiving member at a location thereon which is in alignment with the end surface of the plunging member relative to the respective longitudinal direction of the at least one track;

the stop surface facing the end surface of the plunging member so as to be presented for contacting the end surface of the plunging member in a manner such that the plunging member is displaced in the plunging direction so as to provide gradual resistance to the sliding movement of said at least one limb receiving member in the user-driven direction.

2. The exercise apparatus of claim 1 wherein the plunger is mounted on the at least one limb receiving member and the stop surface is supported on the at least one track.

3. The exercise apparatus of claim 2 wherein the plunger comprises a pair of the end surfaces which are disposed in longitudinally opposite relation to one another each facing in an opposite direction towards one of the first and second ends of the at least one track, and wherein there is provided a pair of the stop surfaces each disposed at or adjacent one of the first and second ends of the at least one track.

4. The exercise apparatus of claim 3 wherein the pair of the end surfaces are carried on distinct plunging members which are movable independently of one another in respective plunging directions, the distinct plunging members being connected to and biased against movement in the respective plunging direction by the biasing member which is common thereto.

5. The exercise apparatus of claim 1 wherein the stop surface is supported in fixed relation to said one of the at least one track and the at least one limb receiving member on which the stop surface is supported.

6. The exercise apparatus of claim 1 wherein the plunging member is resiliently depressible in the plunging direction.

7. An exercise apparatus comprising:

at least one track extending in a respective longitudinal direction from a first end of the at least one track to a second end thereof, the at least one track including first and second sides spanning between the first and second ends;

at least one limb receiving member defining a top surface for receiving a limb of a user and having first and second ends spaced apart in the respective longitudinal direction of the at least one track by a smaller distance than between the first and second ends of the at least one track;

the at least one limb receiving member being operatively coupled to the at least one track so as to be slidable relative thereto in a user-driven direction of sliding movement between the first end and the second end of the at least one track;

the at least one track comprising an upper load bearing surface respectively supporting the at least one limb receiving member in sliding contact therewith and a lower surface adapted for resting on a support surface;

a resistance generating member mounted on the at least one limb receiving member so as to be movable therewith, the resistance generating member being disconnected from the at least one track and arranged for releasable contact therewith at predetermined longitudinal locations of the at least one limb receiving member along the at least one track for generating at said predetermined locations resistance to the sliding movement of said at least one limb receiving member in the driven direction;

wherein the resistance generating member comprises a plunger which is depressible in a plunging direction substantially parallel to the respective longitudinal direction of the at least one track, the plunger defining an end surface which is oriented transversely to the plunging direction and which is movable relative to the at least one limb receiving member upon depression of the plunger; a nd there is provided a stop surface oriented transversely to the plunging direction and supported on the at least one track at a location thereon which is in alignment with the end surface of the plunger relative to the respective longitudinal direction of the at least one track; the stop surface facing the end surface of the plunger.

8. The exercise apparatus of claim 7 wherein the plunger comprises a pair of the end surfaces which are disposed in longitudinally opposite relation to one another each facing in an opposite direction towards one of the first and second ends of the at least one track, and wherein there is provided a pair of the stop surfaces each disposed at or adjacent one of the first and second ends of the at least one track.

9. The exercise apparatus of claim 8 wherein each one of the pair of the end surfaces are carried on a distinct member of the plunger which is displaceable in a direction parallel to the plunging direction, the distinct members which carry the end surfaces of the plunger being biased against displacement in said direction parallel to the plunging direction by a common biasing member.

10. The exercise apparatus of claim 7 wherein the stop surface is supported in fixed relation to said one at least one track.

11. The exercise apparatus of claim 7 wherein the plunger is resiliently depressible.

* * * * *